US009759018B2

(12) United States Patent
Stibich et al.

(10) Patent No.: US 9,759,018 B2
(45) Date of Patent: Sep. 12, 2017

(54) SYSTEM AND METHOD OF ALIGNMENT FOR HYDRAULIC COUPLING

(71) Applicant: Hydril USA Distribution LLC, Houston, TX (US)

(72) Inventors: Alex David Stibich, Houston, TX (US); Eric Dale Larson, Houston, TX (US); Jamie Clay Gamble, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 14/963,849

(22) Filed: Dec. 9, 2015

(65) Prior Publication Data

US 2016/0168926 A1 Jun. 16, 2016

Related U.S. Application Data

(60) Provisional application No. 62/091,160, filed on Dec. 12, 2014, provisional application No. 62/097,845, filed on Dec. 30, 2014.

(51) Int. Cl.
*E21B 19/00* (2006.01)
*E21B 17/01* (2006.01)

(52) U.S. Cl.
CPC ..... *E21B 19/004* (2013.01); *E21B 17/01* (2013.01)

(58) Field of Classification Search
CPC ... E21B 17/01; E21B 47/0001; E21B 43/0107
See application file for complete search history.

(56) References Cited

U.S. PATENT DOCUMENTS 3,643,751 A * 2/1972 Crickmer ..... E21B 17/01 166/355
3,902,554 A 9/1975 Hooper
4,109,938 A 8/1978 Mitchell et al.
(Continued)

FOREIGN PATENT DOCUMENTS

CN 201250646 Y 6/2009
WO 0001915 A2 1/2000
WO 2013192494 A1 12/2013

OTHER PUBLICATIONS

McCord, "A Multiplex System for a Small Remotely Manned Submersible", IEEE Ocean 1975, pp. 361-364, 1975.
(Continued)

*Primary Examiner* — James G Sayre
(74) *Attorney, Agent, or Firm* — Hogan Lovells US LLP

(57) ABSTRACT

A system for aligning an auxiliary line connection in a termination assembly of a marine riser assembly includes a terminal block secured to an outer diameter of a termination ring. The terminal block has a piston housing that extends through a sidewall of the termination ring. A ring adapter has an outer diameter sized to engage an inner diameter of the termination ring when a shoulder of the ring adapter is landed on a load shoulder of the termination ring. A moveable floating ring assembly is retained within the piston pocket of the ring adapter. A piston housed within piston housing is moveable between a retracted position where an outer end of the piston is spaced apart from the floating ring assembly, and an extended position for forming a sealed auxiliary path from the terminal block to the ring adapter.

20 Claims, 6 Drawing Sheets

(56) References Cited

U.S. PATENT DOCUMENTS 4,592,426 A 6/1986 Neely
4,618,173 A 10/1986 Dopyera et al.
4,709,726 A * 12/1987 Fitzgibbons ..... E21B 33/038 137/614.04
5,314,024 A * 5/1994 Rodgers ..... F16L 27/06 166/347
5,778,918 A 7/1998 McLelland
5,781,192 A 7/1998 Kodimer
5,867,150 A 2/1999 Bricklin et al.
6,040,969 A 3/2000 Winch et al.
6,041,804 A * 3/2000 Chatufale ..... E21B 34/04 137/15.23
6,835,292 B2 12/2004 Sato et al.
6,957,205 B1 10/2005 Liongosari
6,961,226 B2 11/2005 Mason, Jr. et al.
6,990,498 B2 1/2006 Fenton et al.
7,000,890 B2 * 2/2006 Bell ..... E21B 34/04 251/129.15
7,111,874 B2 * 9/2006 Smith, III ..... F16L 17/02 277/602
7,113,668 B2 9/2006 Sorum et al.
7,216,715 B2 5/2007 Reynolds
7,261,162 B2 8/2007 Deans et al.
7,337,848 B2 3/2008 Fraser et al.
7,558,684 B2 7/2009 Patten et al.
7,571,772 B2 8/2009 Reams
7,760,670 B2 7/2010 Causier
7,832,706 B2 11/2010 Judge
7,849,599 B2 12/2010 Huff et al.
7,887,103 B2 2/2011 Evans et al.
7,913,767 B2 * 3/2011 Larson ..... E21B 17/085 166/242.6
7,975,770 B2 7/2011 Keener
8,020,623 B2 9/2011 Parks et al.
8,054,593 B2 11/2011 Reid et al.
8,157,025 B2 4/2012 Johnson
8,157,295 B2 4/2012 Krywitsky
8,230,735 B2 7/2012 Chouzenoux et al.
8,322,436 B2 12/2012 Maa
8,388,255 B2 3/2013 Larson et al.
8,403,053 B2 3/2013 Judge
8,464,797 B2 6/2013 Singh et al.
8,469,048 B2 * 6/2013 Bresnahan ..... F15B 13/028 137/112
8,602,108 B2 12/2013 Mathis
8,708,054 B2 4/2014 Dailey, Jr.
8,724,957 B2 5/2014 Oisel et al.
8,781,743 B2 7/2014 McKay et al.
8,812,274 B2 8/2014 Virkar et al.
8,944,403 B2 * 2/2015 Jurena ..... E21B 33/062 166/85.4
9,057,751 B2 6/2015 Spencer et al.
9,085,948 B2 7/2015 Egeland
9,151,794 B2 10/2015 Radan
9,328,569 B2 * 5/2016 Gilmore ..... E21B 17/01
2010/0300696 A1 12/2010 McCalvin et al.
2011/0266002 A1 11/2011 Singh et al.
2012/0233128 A1 9/2012 Solmer
2012/0312546 A1 12/2012 Bussear et al.
2012/0318517 A1 * 12/2012 Christensen ..... E21B 17/07 166/345
2013/0054034 A1 2/2013 Ebenezer
2013/0118755 A1 5/2013 Kotrla et al.
2013/0253872 A1 9/2013 Curtis et al.
2013/0255956 A1 * 10/2013 Gilmore ..... E21B 17/07 166/345
2013/0283919 A1 10/2013 Coonrod et al.
2014/0061516 A1 3/2014 Gustafson et al.
2014/0064029 A1 3/2014 Jaffrey
2014/0083711 A1 * 3/2014 Springett ..... E21B 19/004 166/345
2014/0209316 A1 * 7/2014 Tindle ..... E21B 33/035 166/345
2014/0321341 A1 10/2014 Kristiansen
2014/0361785 A1 12/2014 Radan
2015/0015066 A1 1/2015 Dong et al.
2015/0041122 A1 2/2015 Valsecchi
2015/0101674 A1 * 4/2015 Gustafson ..... E21B 34/045 137/14
2015/0129233 A1 5/2015 Gaude et al.
2015/0184505 A1 7/2015 Panicker-Shah
2015/0198001 A1 7/2015 McWhorter et al.
2015/0233202 A1 8/2015 Caldwell et al.
2015/0260203 A1 9/2015 Launonen et al.
2015/0337607 A1 * 11/2015 Latimer ..... E21B 17/017 166/345
2016/0084066 A1 * 3/2016 DeBerry ..... E21B 17/085 166/336
2016/0153257 A1 * 6/2016 Lokka ..... E21B 17/01 166/359
2016/0177651 A1 * 6/2016 Lyle ..... E21B 33/038 166/345
2016/0319623 A1 * 11/2016 Larson ..... E21B 33/061

OTHER PUBLICATIONS

Hickok, "Practical Experience Of Control Valve Behavior", Subsea Control and Data Acquisition: Proceedings of an International conference, London, UK, pp. 195-203, Apr. 4-5, 1990.
Martin et al., "A Proven Oil/WaterlGas Flowmeter for Subsea, Offshore Technology Conference", Offshore Technology Conference, Houston, pp. 589-596, May 6-9, 1991.
Ali et al., "Subsea Valve Actuator For Ultra Deepwater", Offshore Technology Conference, Houston, Texas, 1996 proceedings, pp. 799-809, May 6-9, 1996.
Altamiranda et al., "Intelligent Supervision and Integrated Fault Detection and Diagnosis for Subsea Control Systems", OCEANS 2007 Europe, pp. 1-6, Jun. 18-21, 2007.
Wang et al., "Water Hammer Effects on Water Injection Well Performance and Longevity", Society of Petroleum Engineers, SPE International Symposium and Exhibition on Formation Damage Control,Lafayette, Louisiana, USA, pp. 1-10, Feb. 13-15, 2008.
Vetcogray, "Capital Drilling Equipment", retrieved from http://site.ge-energy.com/businesses/ge_oilandgas/en/literature/en/downloads/capital_drilling_equipment.pdf, pp. 1-15, 2008.
Altamiranda et al., "Condition Monitoring and Diagnosis for Subsea Control Systems. A Subsystem Prototype", OCEANS 2009 EUROPE, pp. 1-6, May 11-14, 2009.
Whitby et al., "20KSI BOP Stack Development", SPE International, pp. 1-5, Feb. 2-4, 2010.
Tang et al., "A Dynamic Simulation Study of Water Hammer for Offshore Injection Wells To Provide Operation Guidelines", SPE Production & Operations, vol. No. 25, Issue No. 4, pp. 509-523, Nov. 2010.
Shanks et al., "OTC 23473 New Generation Control System For 20 KSI Subsea BOP", Offshore Technology Conference, pp. 1-12, May 3, 2012.
Levine et al., "BSEE and BOEM Workshop with Government of Israel Application for Permit to Drill", pp. 1-40, Jul. 24, 2012.
Cai et al., "Reliability Analysis of Subsea Blowout Preventer Control Systems Subjected to Multiple Error Shocks", Journal of Loss Prevention in The Process Industries, vol. No. 25, Issue No. 6, pp. 1044-1054, Nov. 1, 2012.
Cai et al., "Application of Bayesin Networks to Reliability Evaluation of Software Systems for Subsea Blowout Preventers", International Journal of Control and Automation, pp. 47-60, Feb. 28, 2013.
Umofia., "Risk-Based Reliability Assessment of Subsea Control Module for Offshore Oil and Gas production", Cranfield University, School of Engineering, Department of Offshore, Process and Energy Engineering, pp. 1-284, Sep. 2014.
Chazal et al., "Enhancements in Fraction Measurements and Flow Modeling For Multiphase Flowmeters" Society of Petroleum Engineers, SPE Annual Technical Conference and Exhibition, pp. 1-19, Oct. 27-29, 2014.
PCT Search Report and Written Opinion issued in connection with Related Application No. PCT/US2015/053238 on Feb. 1, 2016.

(56) References Cited

OTHER PUBLICATIONS

PCT Search Report and Written Opinion issued in connection with Related Application No. PCT/US2015/055915 on Feb. 2, 2016.
GE Oil & Gas, "GE's 20-ksi" BOP Completely Re-Engineered to Meet Demands of HPHT Reservoirs, Drilling Contractor, pp. 1-2, Feb. 17, 2016.
Cameron., "Mark III Subsea MUX BOP Control System", Drilling Pressure Control Equipment, retrieved from http://www.c-a-m.com/products-and-services/drilling/drilling-pressure-control-equipment/mark-iii-subsea-mux-bop-control-system, pp. 1-4, Feb. 19, 2016.
PCT Search Report and Written Opinion issued in connection with Corresponding Application No. PCT/US2015/065227 on Mar. 11, 2016.
U.S. Appl. No. 62/097,845, filed Dec. 30, 2014, Alex David Stibich.
U.S. Appl. No. 14/870,249, filed Sep. 30, 2015, John S.Holmes et al.
U.S. Appl. No. 14/884,563, filed Oct. 15, 2015, John Steven Holmes et al.
U.S. Appl. No. 14/938,074, filed Nov. 11, 2015, John S. Holmes et al.
U.S. Appl. No. 14/972,848, filed Dec. 17, 2015, Glen Allen Scott et al.
U.S. Appl. No. 14/971,381, filed Dec. 16, 2015, Michael James Connor et al.
U.S. Appl. No. 14/972,266, filed Dec. 17, 2015, William James Hatter et al.
U.S. Appl. No. 14/971,669, filed Dec. 16, 2015, Thomas David Beales et al.
U.S. Appl. No. 14/971,305, filed Dec. 16, 2015, Thomas David Beales et al.
U.S. Appl. No. 14/938,599, filed Nov. 11, 2015, Alexander Michael Mcauley et al.

* cited by examiner

SYSTEM AND METHOD OF ALIGNMENT FOR HYDRAULIC COUPLING

CROSS REFERENCE TO RELATED APPLICATION

This application claims priority to and the benefit of: U.S. Provisional Application Ser. No. 62/091,160, titled "Floating Seal Ring Coupling," filed Dec. 12, 2014; and U.S. Provisional Application Ser. No. 62/097,845, titled "Floating Female Hydraulic Coupling," filed Dec. 30, 2014 the full disclosure of each which is hereby incorporated herein by reference in its entirety for all purposes.

BACKGROUND OF THE DISCLOSURE

1. Field of the Disclosure

The present disclosure relates in general to marine drilling riser systems and in particular to auxiliary line connections in a termination assembly of a marine riser assembly.

2. Description of Related Art

In offshore hydrocarbon drilling and production operations, a riser can be supported by the offshore platform through a termination ring. A flex joint and a diverter can be located at an upper end of the riser system and mechanically connected to the offshore platform. A telescopic joint or slip joint can be associated with the termination ring to adjust for a change in length of the riser system as the offshore platform moves relative to the subsea wellhead. In order to provide a conduit for auxiliary fluids and communication lines to travel from the offshore platform to the riser system, drape hoses can extend from the offshore platform to the termination ring by way of a terminal block that is associated with the termination ring. A fluidly sealed connection is made up between the drape hoses and the riser system.

In some current designs, a piston extends from a terminal block of the termination ring and is moved into a piston receptacle of the riser system. However, the weight of the drape hose and a radially extending portion of the terminal block, such as a gooseneck, biases the terminal block downward and in tension causing a bending moment and deflection of the terminal block relative to the piston receptacle of the riser system. This can case misalignment between the piston and the piston receptacle and can result in the piston to scraping along a side of the piston receptacle while trying to stab the piston into the piston receptacle, leading to galling on both the piston and the piston receptacle. Galling can cause permanent damage to the piston and the piston receptacle, requiring rework or replacement. In addition, because the piston can be misaligned with the piston receptacle and subject to a bending moment, the piston can become locked in the piston receptacle and be unable to be released. Both locking of the piston and permanent damage to the piston or piston receptacle can require rework or replacement of the components and can therefore result in downtime and lost revenue.

SUMMARY OF THE DISCLOSURE

Embodiments described herein provide systems and methods for aligning a piston with a piston receptacle for making up a sealed auxiliary line connection. In embodiments of this disclosure, when the piston actuates and stabs into the piston receptacle, the piston receptacle can float so that the piston aligns concentrically within the piston receptacle. Seals within the piston receptacle provide a fluidly sealed connection within the floating piston receptacle assembly. The floating piston assembly is a removable, serviceable, and replaceable unit.

In an embodiment of the current disclosure, a system for aligning an auxiliary line connection in a termination assembly of a marine riser assembly includes a terminal block secured to an outer diameter of a termination ring. The terminal block has a piston housing that extends through a sidewall of the termination ring. The termination ring has a load shoulder on an inner diameter of the termination ring. The system also includes a ring adapter with a shoulder, the ring adapter having an outer diameter sized to engage an inner diameter of the termination ring when the shoulder of the ring adapter is landed on the load shoulder of the termination ring. A piston pocket extends radially inward from the outer diameter of the ring adapter. A floating ring assembly is retained within the piston pocket, the floating ring assembly moveable within the piston pocket. A piston is housed within piston housing. The piston has a central bore and is moveable between a retracted position where an outer end of the piston is spaced apart from the floating ring assembly, and an extended position where an outer surface of the piston engages an inner surface of the floating ring assembly, forming an auxiliary path from the terminal block to the ring adapter.

In another embodiment of this disclosure, a system for aligning an auxiliary line connection in a termination assembly of a marine riser assembly includes a terminal block secured to an outer diameter of a termination ring. The terminal block has a piston housing that extends through a sidewall of the termination ring, the piston housing being in communication with a platform auxiliary line. A ring adapter is landed within an inner diameter of the terminal block, the ring adapter being part of the marine riser assembly. A piston pocket extends radially inward from the outer diameter of the ring adapter. A floating ring assembly is retained within the piston pocket, the floating ring assembly moveable within the piston pocket. The ring adapter has a riser auxiliary line in communication with a receptacle bore of the floating ring assembly. A piston is housed within piston housing, the piston having a central bore and being moveable between a retracted position, and an extended position. A first seal is located between the floating ring assembly and the piston pocket and a second seal located between the floating ring assembly and the piston so that when the piston is in the extended position, the piston forms a sealed auxiliary path from the platform auxiliary line to the riser auxiliary line.

In yet another embodiment of this disclosure, a method for aligning an auxiliary line connection in a termination assembly of a marine riser assembly includes securing a terminal block to an outer diameter of a termination ring. The terminal block has a piston housing that extends through a sidewall of the termination ring, and a load shoulder on an inner diameter of the termination ring. A shoulder of a ring adapter is landed on the load shoulder of the termination ring. The ring adapter has an outer diameter sized to engage an inner diameter of the termination ring. The ring adapter has a piston pocket extending radially inward from the outer diameter of the ring adapter, and a floating ring assembly retained within the piston pocket. The floating ring assembly is moveable within the piston pocket. A piston is moved between a retracted position where an outer end of the piston is located within the piston housing, and an extended position where an outer surface of the piston engages an inner surface of the floating ring assembly, forming an auxiliary path from the terminal block to the ring adapter, the piston being located within a piston housing and having a central bore.

BRIEF DESCRIPTION OF THE DRAWINGS

So that the manner in which the features, advantages and objects of the disclosure, as well as others which will become apparent, are attained and can be understood in more detail, more particular description of embodiments of the disclosure briefly summarized above may be had by reference to the embodiment thereof which is illustrated in the appended drawings, which drawings form a part of this specification. It is to be noted, however, that the drawings illustrate only certain embodiments of the disclosure and is therefore not to be considered limiting of its scope as the disclosure may admit to other equally effective embodiments.

DETAILED DESCRIPTION OF THE DISCLOSURE

The system and method of the present disclosure will now be described more fully hereinafter with reference to the accompanying drawings which illustrate embodiments of the disclosure. The system and method of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments.

Figure 1:
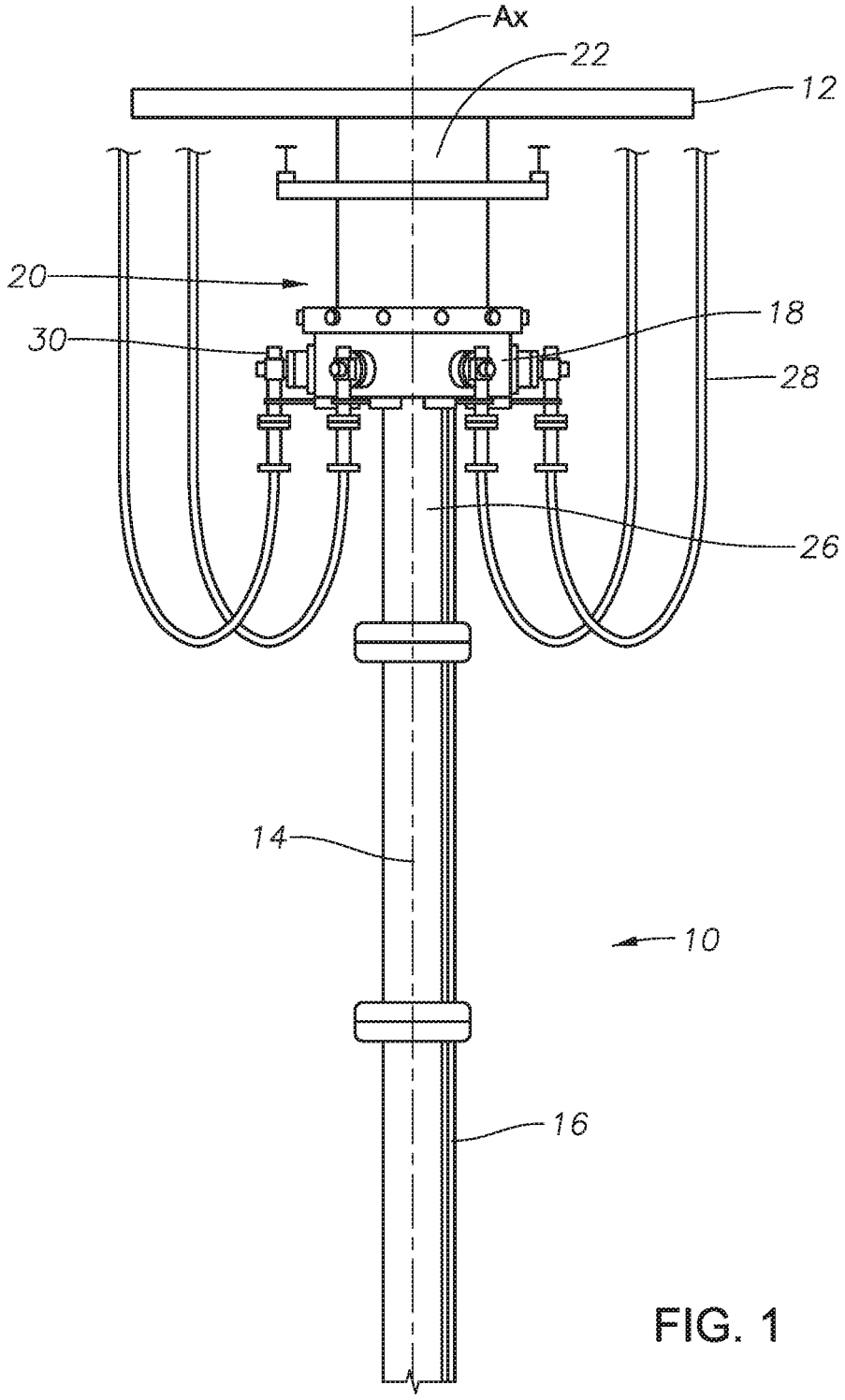
FIG. 1 is a perspective view of a marine riser assembly having a termination assembly in accordance with an embodiment of this disclosure.

Referring to FIG. 1, marine riser assembly 10 can extend from a subsea assembly to deck 12 of an offshore platform. Deck 12 can be, for example, a drill floor of the offshore platform. Riser 14 can be used to convey hydrocarbons and other fluids from the subsea assembly to the offshore platform. Riser auxiliary lines 16 can be used to convey auxiliary fluids or communication means to and from the subsea assembly. Riser 14 can be supported by the offshore platform through termination ring 18. Support members (not shown) can extend between the offshore platform and termination ring 18 so that the weight of termination ring 18 and riser 14 is carried by the offshore platform through the support members. Marine riser assembly 10 and termination ring 18 can be centered on axis Ax.

Termination ring 18 can be located below a flex joint 20 and diverter 22 of marine riser assembly 10. Diverter 22 can be mechanically connected to deck 12 to provide a static connection between the top end of marine riser assembly 10 and deck 12. Flex joint 20 can allow for relative rotational movement between deck 12 and marine riser assembly 10. Termination ring 18 can be connected to ring adapter 24 (FIG. 2) of specialty riser joint (not shown), slip joint or telescopic joint 26 of marine riser assembly 10. Termination ring 18 is a ring shaped member that circumscribes a portion of telescopic joint 26, as will be further described below. Telescopic joint 26 can adjust for a change in length of marine riser assembly 10 as the offshore platform moves relative to the subsea assembly.

Platform auxiliary lines 28 can be used to convey auxiliary fluids or communication means between the offshore platform and termination ring 18. Platform auxiliary lines 28 can be drape hoses or other flexible lines that allow for relative movement between the offshore platform and marine riser assembly 10. Riser auxiliary lines 16 can convey auxiliary fluids or communication means between ring adapter 24 and the subsea assembly. A fluidly sealed connection can be made between termination ring 18 and ring adapter 24 so that platform auxiliary lines 28 can be in communication with riser auxiliary lines 16 through a fluidly sealed path. Sealing can be provided by elastomeric, metal, or other known sealing means that can seal against the pressures acting throughout the path from platform auxiliary lines 28 through to riser auxiliary lines 16.

Figure 2:
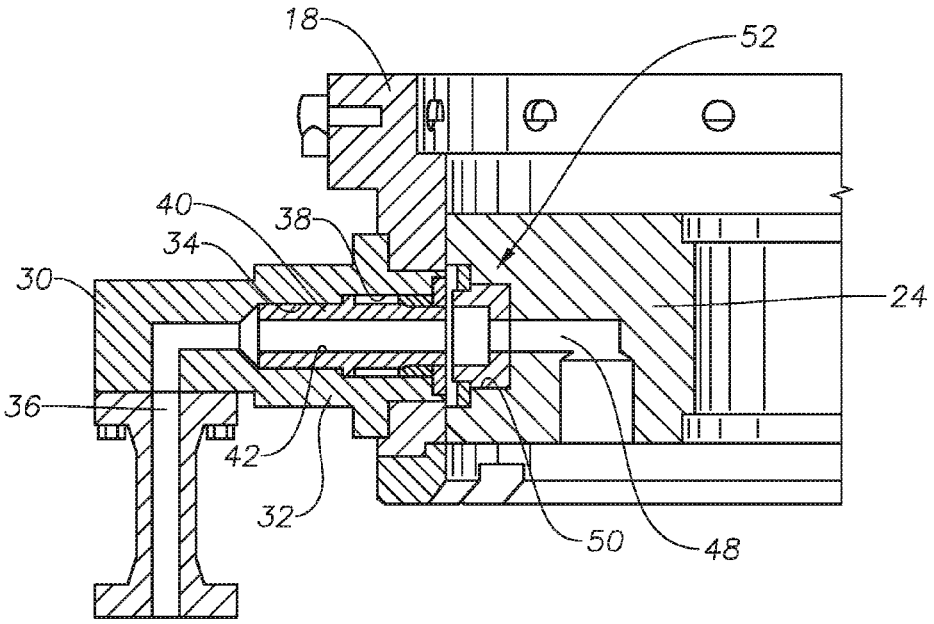
FIG. 2 is a section view of a portion of the termination assembly of FIG. 1, shown with a piston of a terminal block retracted from a floating ring assembly of a ring adapter, in accordance with an embodiment of this disclosure.
Figure 5:
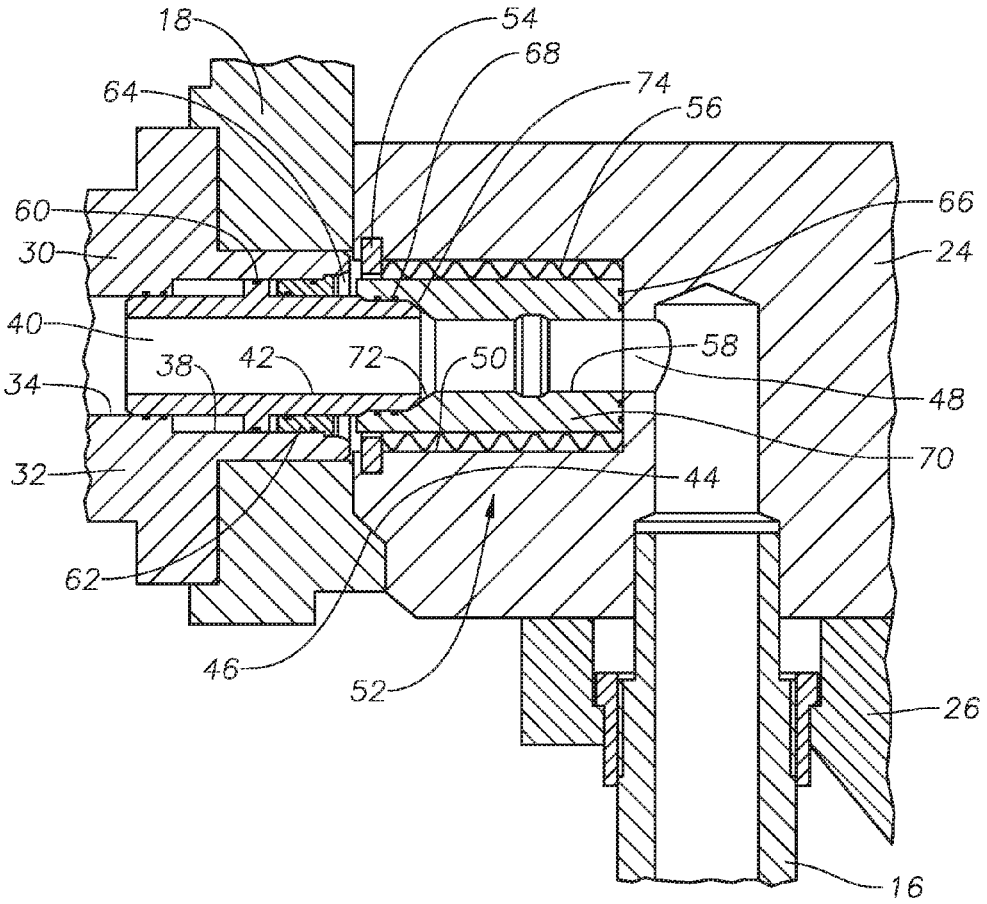
FIG. 5 is a section view of a portion of the termination assembly of FIG. 1, shown with the piston of the terminal block extended into the floating ring assembly of the ring adapter, in accordance with an embodiment of this disclosure.

Looking at FIG. 2, terminal block 30 is secured to an outer diameter of termination ring 18. Terminal block 30 has piston housing 32 that extends through a sidewall of termination ring 18. A seal can be located between terminal block 30 and termination ring 18 to provide a sealed connection between terminal block 30 and termination ring 18 (FIG. 5). Piston housing 32 has housing bore 34 that extends within piston housing 32. An inner end of housing bore 34 opens to an inner diameter surface of termination ring 18. An outer portion of housing bore 34 of piston housing 32 can form a housing auxiliary path 36 which is in communication with platform auxiliary lines 28 through either direct or indirect connection with platform auxiliary lines 28.

An inner portion of housing bore 34 can form piston chamber 38. Piston 40 is located within piston housing 32. Piston 40 has a central bore 42. Central bore 42 is in communication with housing auxiliary path 36.

Figure 4:
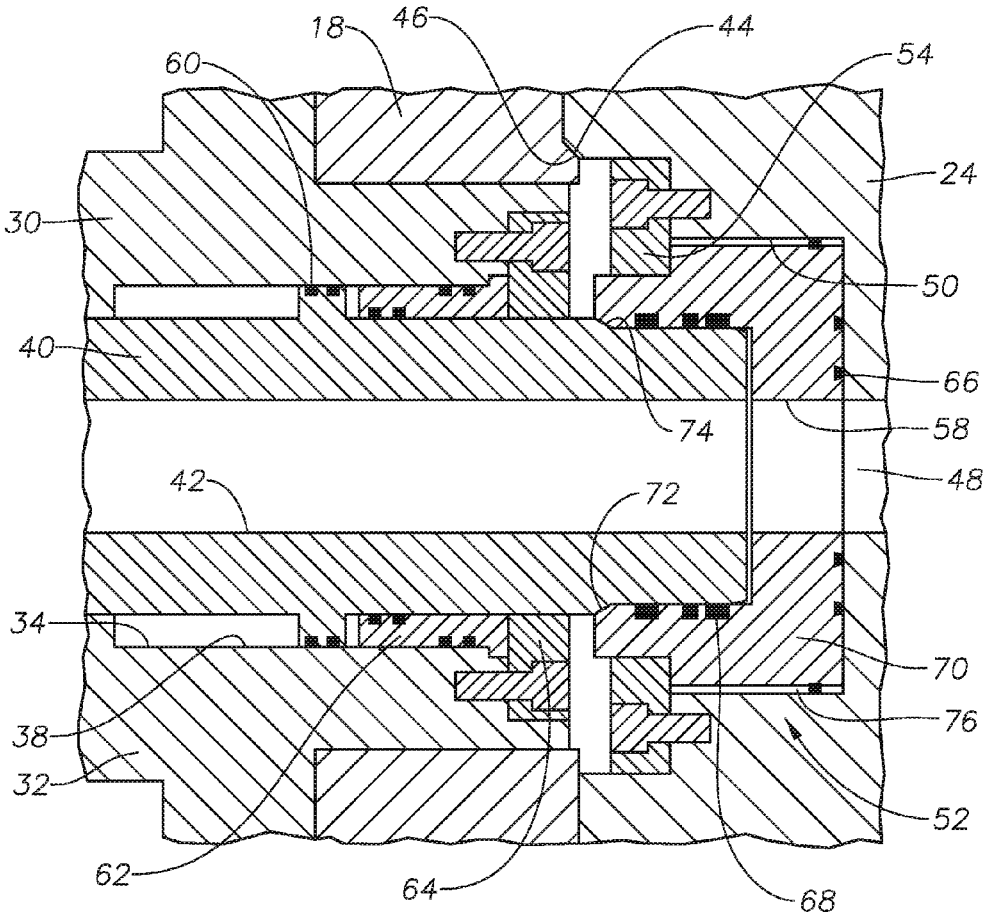
FIG. 4 is a detail section view of the portion of the termination assembly of FIG. 3, shown with the piston of the terminal block extended into the floating ring assembly of the ring adapter.

Referring to FIGS. 4-5, termination ring 18 further has upward facing load shoulder 44 on an inner diameter of termination ring 18. Looking at the example of FIG. 4, load shoulder 44 is located axially above termination ring 18. In the alternate example of FIG. 5, load shoulder 44 is located axially below piston housing 32.

Looking at FIGS. 4-5, ring adapter 24 has downward facing shoulder 46 on an outer diameter of ring adapter 24. Shoulder 46 is sized and located to mate with load shoulder 44 so that when ring adapter 24 is landed within termination ring 18, ring adapter 24 is supported by termination ring 18 on load shoulder 44. Ring adapter 24 has an outer diameter sized to engage an inner diameter of termination ring 18 when shoulder 46 of ring adapter 24 is landed on load shoulder 44 of termination ring 18.

Ring adapter 24 has adapter bore 48 that extends within ring adapter 24. An outer end of adapter bore 48 opens to an outer diameter surface of ring adapter 24 and is generally axially and rotationally aligned with housing bore 34 when ring adapter 24 is landed within termination ring 18. Riser auxiliary line 16 is in communication with adapter bore 48.

Figure 6:
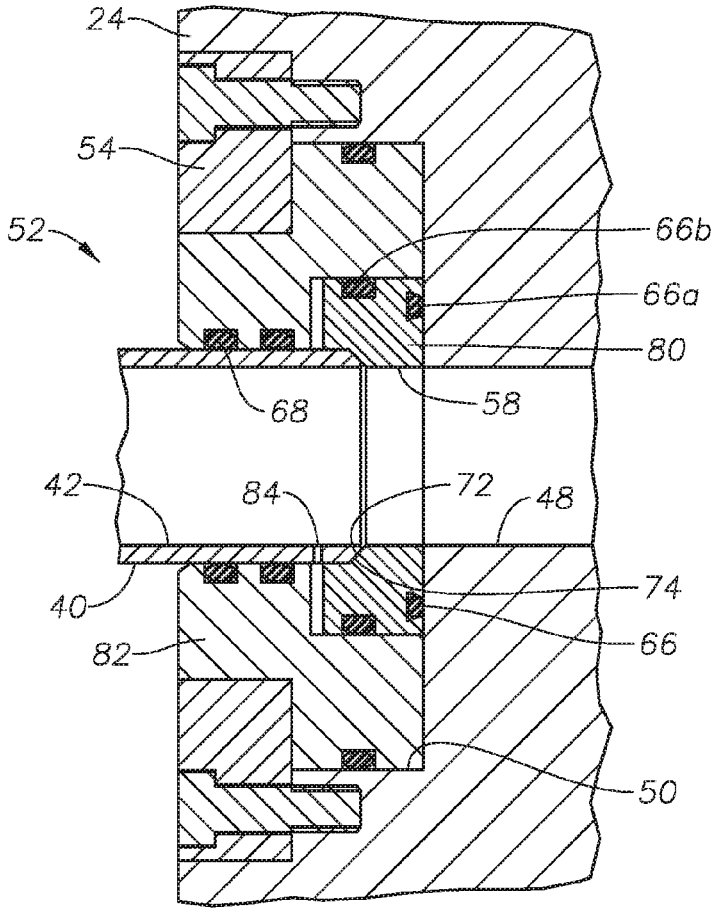
FIG. 6 is a section view of a portion of the ring adapter of FIG. 1, showing the piston of the terminal block extended into the floating ring assembly of the ring adapter, in accordance with an embodiment of this disclosure.
Figure 9:
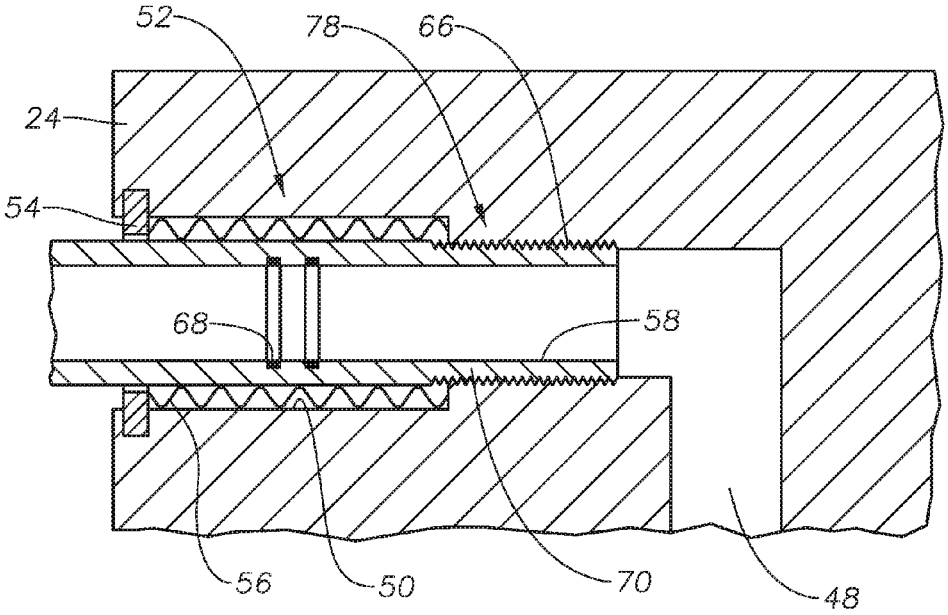
FIG. 9 is a section view of a portion of the ring adapter of FIG. 1, in accordance with an embodiment of this disclosure.

Looking at FIGS. 4-5, piston pocket 50 extends radially inward from the outer diameter of ring adapter 24 at the outer end of adapter bore 48. Piston pocket 50 houses floating ring assembly 52. Floating ring assembly 52 can be retained within piston pocket 50 with floating ring retainer 54. Floating ring retainer 54 can be releasably secured to ring adapter 24 and can engage an outer surface of floating ring assembly 52. Floating ring assembly 52 can be moveable within piston pocket 50. As an example, an outer diameter of floating ring assembly 52 can be less than an inner diameter of piston pocket 50, defining an annular space between the outer diameter of floating ring assembly 52 and the inner diameter of the piston pocket 50, providing floating ring assembly 52 with space to move within piston pocket 50 (FIGS. 4 and 6). In alternate examples, spring member 56 engages the inner diameter of piston pocket 50 and provides sufficient flexibility to allow ring assembly 52 to move within piston pocket 50 (FIGS. 5 and 9).

Floating ring assembly 52 includes receptacle bore 58 that has a first end that aligns with an adjacent portion of adapter bore 48. Receptacle bore 58 is thereby in communication with riser auxiliary line 16 via adapter bore 48. A second end of receptacle bore 58 is sized to accept piston 40.

Figure 3:
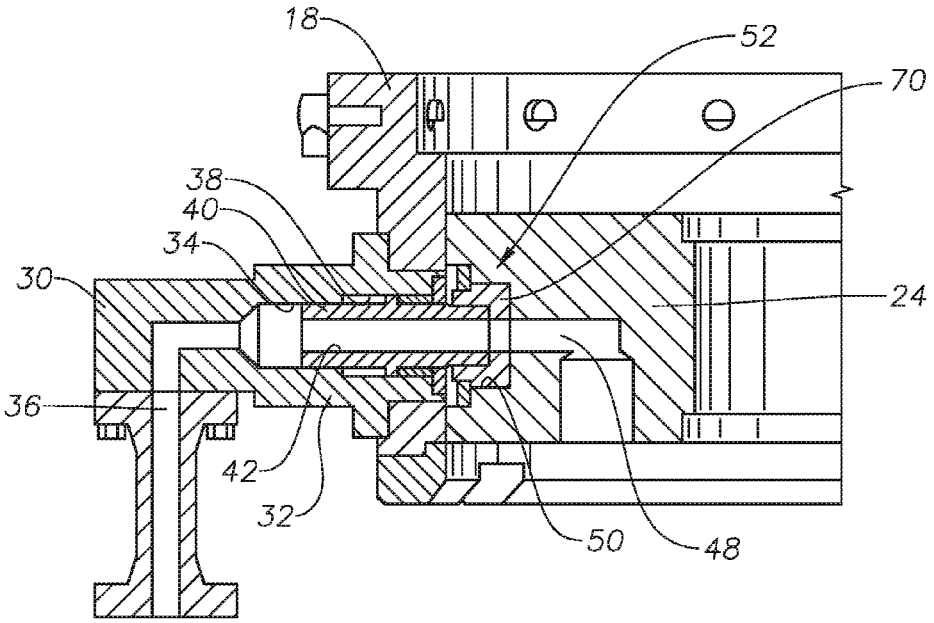
FIG. 3 is a section view of the portion of the termination assembly of FIG. 2, shown with the piston of the terminal block extended into the floating ring assembly of the ring adapter.

Piston 40 can be moved within housing bore 34 between a retracted position (FIG. 2), and an extended position (FIG. 3). In the retracted position, an outer end of piston 40 can be located within piston housing 32, or proximate to the inner diameter surface of piston housing 32. In the retracted position, the outer end of piston 40 is spaced apart from floating ring assembly 52. In the extended position, an outer surface of piston 40 can sealingly engage an inner surface of floating ring assembly 52.

Looking at FIG. 4, to move piston 40 between the retracted and extended positions, a pressure media can be injected into piston chamber 38. Injecting pressure media into piston chamber 38 radially outward of piston seal 60 of piston 40 will urge piston 40 towards the extended position. Injecting pressure media into piston chamber 38 radially inward of piston seal 60 will urge piston 40 towards the retracted position. A seal or packing 62 forms a seal between the outer diameter of piston 40 and the inner diameter of piston chamber 38. Piston retainer 64 retains packing 62 and piston 40 within piston chamber 38.

When piston 40 is in the extended position, a sealed auxiliary path is formed between terminal block 30 and ring adapter 24. A sealed auxiliary path is also formed between platform auxiliary line 28 and riser auxiliary line 16. Floating ring assembly 52 includes seals that seal leak paths through and between the piston 40, the floating ring assembly 52, and piston pocket 50. First seal 66 is located between floating ring assembly 52 and piston pocket 50. In the example embodiments of FIGS. 4-5, first seal 66 is a face seal located between an inner face of floating ring assembly 52 and an opposite facing surface of piston pocket 50, the face seal circumscribing receptacle bore 58 of floating ring assembly 52.

Second seal 68 is located between floating ring assembly 52 and piston 40. Second seal 68 can be located within the inner diameter of receptacle bore 58 and engage an outer diameter of piston 40, forming a seal between floating ring assembly 52 and piston 40.

Looking at the example embodiment of FIG. 4, floating ring assembly 52 includes floating ring 70. Floating ring 70 houses first seal 66 and second seal 68. Floating ring 70 includes floating ring shoulder 72. Floating ring shoulder 72 is an annular surface on an inner diameter of receptacle bore 58. Floating ring shoulder 72 can be sloped or can be generally normal to a central axis of floating ring assembly 52 and can mate with piston shoulder 74 of piston 40. Piston shoulder 74 is an annular surface located on piston 40. Floating ring shoulder 72 is positioned so that when piston 40 is in the extended position; piston shoulder 74 engages floating ring shoulder 72 and pushes floating ring assembly 52 into sealing engagement with piston pocket 50 by energizing first seal 66. Alternately, instead of floating ring shoulder 72 mating with piston shoulder 74 of piston 40, an outer end surface of piston 40 can engage an inner end surface of floating ring 70 (FIG. 3) to push floating ring assembly 52 into sealing engagement with piston pocket 50 by energizing first seal 66.

In the example of FIG. 4, floating ring shoulder 72 is at an outer end of floating ring 70 of floating ring assembly 52. As piston 40 moves from the retracted position to the extended position, the outer end of piston 40 may engage floating ring shoulder 72 to assist in aligning piston 40 within floating ring assembly 52. Floating ring retainer 54 retains floating ring 70 within piston pocket 50. However, because the outer diameter of floating ring 70 is less than an inner diameter of piston pocket 50, gap 76, which can form an annular space between the outer diameter of floating ring 70 and the inner diameter of the piston pocket 50, provides floating ring 70 with space to move within piston pocket 50. This allowable movement reduces or eliminates the problem of interference between, and galling of, piston 40 and receptacle bore 58. Additionally, because relative movement between floating ring 70 and piston pocket 50 is allowable and piston receptacle bore 58 can re-orient to align with piston 40, close machining tolerances are not required, reducing the cost of manufacturing the components of floating ring assembly 52 compared to some current designs.

In the example of FIGS. 5 and 9, floating ring 70 is an inner tube. In the example of FIG. 5, floating ring 70 houses first seal 66 and second seal 68. Spring member 56 circumscribes floating ring 70 and is sized to engage the inner diameter of piston pocket 50. In the example of FIG. 5, floating ring 70 includes floating ring shoulder 72, which can mate with piston shoulder 74 of piston 40 to push floating ring assembly 52 into sealing engagement with piston pocket 50 by energizing first seal 66. In such an embodiment, floating ring shoulder 72 is spaced radially inward of an outer end of floating ring 70 of floating ring assembly 52.

Figure 7:
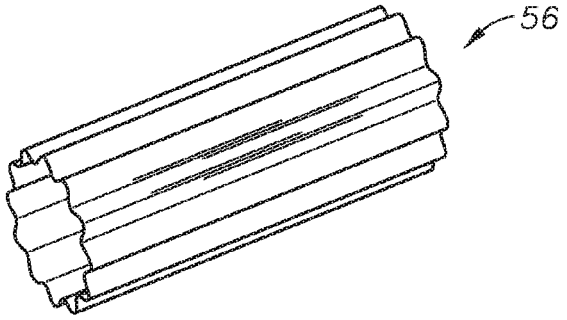
FIG. 7 is a perspective view of a spring member of the termination assembly of FIG. 5, in accordance with an embodiment of this disclosure.
Figure 8:
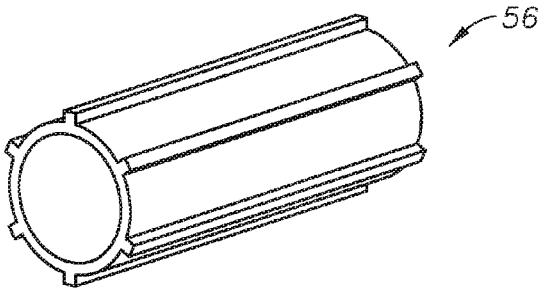
FIG. 8 is a perspective view of a spring member of the termination assembly of FIG. 5, in accordance with an embodiment of this disclosure.

In the example of FIG. 5, floating ring retainer 54 retains floating ring 70 within piston pocket 50. However, spring member 56 provides floating ring 70 with the ability to move within piston pocket 50. Spring member 56 can be ring shaped or can be an elongated member. Spring member 56 can be, as an example, a marcel spring or expander (FIG. 7), foam metal, a linear spring (FIG. 8), a wave spring, spring plungers, or a similar spring type device, or combination thereof.

In the example of FIG. 9, first seal 66 is formed by threaded connection 78 between outer threads of floating ring 70 of floating ring assembly 52 and inner threads on the inner diameter surface of piston pocket 50. Because threaded connection 78 can retain floating ring 70 within piston pocket 50, floating ring retainer 54 retains spring member 56 within piston pocket 50, but is not required to retain floating ring 70 within piston pocket 50. In such an embodiment, floating ring 70 is formed with the ability to cantilever so that the outer free end of floating ring 70 can move relative to threaded connection 78.

In the example of FIG. 6, floating ring assembly 52 includes seal carrier 80 and seal ring 82. Both seal carrier 80 and seal ring 82 can include a first seal 66 for sealing between floating ring assembly 52 and piston pocket 50. First seal 66 includes both a face seal 66*a*, and a circumferential seal 66*b*. Face seal 66*a* is carried by seal carrier 80 between the inner face of seal carrier 80 and an opposite facing surface of piston pocket 50, the face seal circumscribing receptacle bore 58 of floating ring assembly 52. Circumferential seal 66*b* circumscribes an outer diameter of seal carrier 80. Seal ring 82 houses second seal 68, which is located within the inner diameter of receptacle bore 58 and engages an outer diameter of piston 40, forming a seal between floating ring assembly 52 and piston 40.

Floating ring assembly 52 of the example of FIG. 6 includes floating ring shoulder 72. Floating ring shoulder 72 is an annular surface on an inner diameter of seal carrier 80. Floating ring shoulder 72 can be sloped or can be generally normal to a central axis of floating ring assembly 52 and can mate with piston shoulder 74 so that when piston 40 is in the extended position, piston shoulder 74 engages floating ring shoulder 72 and pushes seal carrier 80 into sealing engagement with piston pocket 50 by energizing first seal 66.

In order to alternately engage face seal 66*a*, pressure path 84 can extend through a sidewall of piston 40. Pressure path 84 is positioned so that it provides a pressure media path from within central bore 42, through the sidewall of piston 40, and to an outer end surface of seal carrier 80 when piston 40 is in the extended position, providing a pressure to energize second seal 68 and retain face seal 66*a* in sealing engagement with the opposite facing surface of piston pocket 50 with pressure media that is traveling through central bore 42.

Before piston 40 is moved to the extended position, there can be gaps or spaces between and around each of seal carrier 80, seal ring 82 and piston pocket 50 so that seal carrier 80 and seal ring 82 can move relative to each other and relative to piston pocket 50 so that floating ring 70 has space to move within piston pocket 50. This allowable movement reduces or eliminates the problem of interference between, and galling of, piston 40 and receptacle bore 58.

In an example of operation, ring adapter 24 is attached to telescopic joint 26 below diverter 22 and the telescopic joint 26 with ring adapter 24 is lowered through termination ring 18 until shoulder 46 of ring adapter 24 lands on, and is supported by, load shoulder 44 of termination ring 18. Orientation and locking dogs can help to position and align ring adapter 24 within termination ring 18 as well as secure ring adapter 24 to termination ring 18.

Piston 40 can then be moved within housing bore 34 between the retracted position and the extended position so that an outer surface of piston 40 engages an inner surface of floating ring assembly 52. Piston 40 can be moved to the extended position, for example, by injecting pressure media into piston chamber 38 radially outward of piston seal 60 of piston 40. Floating ring assembly 52 allows an inner tube, such as floating ring 70 to float relative to an outer tube, such as piston pocket 50, and can help to centralize piston 40. If the centerlines of piston 40 and receptacle bore 58 are not on the same axis, the hydraulic actuation of piston 40 can push out and initially contact floating ring shoulder 72. Floating ring assembly 52 can adjust to accommodate misalignment so that piston 40 does not go into and gall against a rigid object. The float occurring within floating ring assembly 52 does not translate the bending stress from the gooseneck and weight of the platform auxiliary lines 28 into the connection between piston 40 and receptacle bore 58.

Floating ring assembly 52 is serviceable and replaceable. Although described herein as being part of ring adapter 24, in alternate embodiments, floating ring assembly could be instead adapted to be part of piston housing 32.

Therefore embodiments of this disclosure provide systems and methods system for aligning an auxiliary line connection in a termination assembly of a marine riser assembly that can result in less downtime and rework, and minimize a "rig down" scenario that causes lost revenue for the operator and contractor, and that can pull engineers off their current projects to focus solely on fixing that problem, compared to some current systems.

The terms "vertical", "horizontal", "upward", "downward", "above", and "below" and similar spatial relation terminology are used herein only for convenience because elements of the current disclosure may be installed in various relative positions.

While embodiments of the disclosure have been shown or described in only some of their forms, it should be apparent to those skilled in the art that it is not so limited, but is susceptible to various changes without departing from the scope of the disclosure.

What is claimed is:

1. A system for aligning an auxiliary line connection in a termination assembly of a marine riser assembly, the system comprising:

a terminal block secured to an outer diameter of a termination ring, the terminal block having a piston housing that extends through a sidewall of the termination ring, and the termination ring having a load shoulder on an inner diameter of the termination ring;

a ring adapter with a shoulder, the ring adapter having an outer diameter sized to engage the inner diameter of the termination ring when the shoulder of the ring adapter is landed on the load shoulder of the termination ring;

a piston pocket extending radially inward from the outer diameter of the ring adapter;

a floating ring assembly retained within the piston pocket, the floating ring assembly moveable within the piston pocket; and a piston housed within the piston housing, the piston having a central bore and being moveable between a retracted position where an outer end of the piston is spaced apart from the floating ring assembly, and an extended position where an outer surface of the piston engages an inner surface of the floating ring assembly, forming an auxiliary path from the terminal block to the ring adapter.

2. The system of claim 1, further comprising a face seal located between an inner face of the floating ring assembly and an opposite facing surface of the piston pocket, the face seal circumscribing a receptacle bore of the floating ring assembly.

3. The system of claim 1, further comprising a piston shoulder and a floating ring shoulder, the piston shoulder being an annular surface located on the piston and the floating ring shoulder being an annular surface located on an inner diameter surface of the floating ring assembly and positioned so that when the piston is in the extended position, the piston shoulder engages the floating ring shoulder and pushes the floating ring assembly into sealing engagement with the piston pocket.

4. The system of claim 1, further comprising a floating ring shoulder located on an inner diameter surface of the floating ring assembly at an outer end of the floating ring assembly, the floating ring shoulder being an annular surface engagable by the outer end of the piston as the piston moves from the retracted position to the extended position to align the piston within the floating ring assembly.

5. The system of claim 1, further comprising a floating ring retainer, the floating ring retainer being releasably secured to the ring adapter and engaging an outer surface of the floating ring assembly.

6. The system of claim 1, wherein the floating ring assembly includes a seal ring having a piston seal on an inner diameter of the seal ring for sealingly engaging the outer diameter of the piston, the floating ring assembly further comprising a seal carrier having a face seal located on an inner end surface of the seal carrier and an outer diameter seal that forms a fluid seal between an outer diameter of the seal carrier and the inner diameter of the seal ring.

7. The system of claim 6, wherein the piston has a pressure path extending through a sidewall of the piston, the pressure path being positioned so that the pressure path provides a pressure media path from within the central bore of the piston to an outer end surface of the seal carrier when the piston is in the extended position, providing a pressure on the outer end surface of the seal carrier to retain the face seal of the seal carrier in sealing engagement with an opposite facing surface of the piston pocket.

8. The system of claim 1, wherein an outer diameter of the floating ring assembly is less than an inner diameter of the piston pocket, defining an annular space between the outer diameter of the floating ring assembly and the inner diameter of the piston pocket.

9. The system of claim 1, wherein the floating ring assembly includes an inner tube having a piston seal on an inner diameter of the inner tube for sealingly engaging an outer diameter of the piston, and wherein the system further includes a spring member circumscribing the inner tube and sized to engage an inner diameter of the piston pocket.

10. A system for aligning an auxiliary line connection in a termination assembly of a marine riser assembly, the system comprising:

a terminal block secured to an outer diameter of a termination ring, the terminal block having a piston housing that extends through a sidewall of the termination ring, the piston housing being in communication with a platform auxiliary line;

a ring adapter landed within an inner diameter of the terminal block, the ring adapter being part of the marine riser assembly;

a piston pocket extending radially inward from the outer diameter of the ring adapter;

a floating ring assembly retained within the piston pocket, the floating ring assembly moveable within the piston pocket and wherein the ring adapter has a riser auxiliary line in communication with a receptacle bore of the floating ring assembly;

a piston housed within the piston housing, the piston having a central bore and being moveable between a retracted position, and an extended position; and a first seal located between the floating ring assembly and the piston pocket and a second seal located between the floating ring assembly and the piston so that when the piston is in the extended position, the piston forms a sealed auxiliary path from the platform auxiliary line to the riser auxiliary line.

11. The system of claim 10, wherein the first seal includes a face seal located between an inner face of the floating ring assembly and an opposite facing surface of the piston pocket, the face seal circumscribing the receptacle bore of the floating ring assembly.

12. The system of claim 11, further comprising a piston shoulder and a floating ring shoulder, the piston shoulder being an annular surface located on the piston and the floating ring shoulder being an annular surface located on an inner diameter surface of the floating ring assembly and positioned so that when the piston is in the extended position, the piston shoulder engages the floating ring shoulder and energizes the face seal.

13. The system of claim 10, wherein the floating ring assembly includes:

a seal ring housing the first seal;

a seal carrier housing the second seal; and wherein;

the piston has a pressure path extending through a sidewall of the piston, the pressure path being positioned so that the pressure path provides a pressure media path from within the central bore of the piston to an outer end surface of the seal carrier when the piston is in the extended position, providing a pressure to energize the second seal.

14. The system of claim 10, wherein the floating ring assembly includes an inner tube having the first seal on an inner diameter of the inner tube, and wherein the system further includes a spring member circumscribing the inner tube and sized to engage an inner diameter of the piston pocket.

15. A method for aligning an auxiliary line connection in a termination assembly of a marine riser assembly, the method comprising:

securing a terminal block to an outer diameter of a termination ring, the terminal block having a piston housing that extends through a sidewall of the termination ring, and the termination ring having a load shoulder on an inner diameter of the termination ring;

landing a shoulder of a ring adapter on the load shoulder of the termination ring, the ring adapter having an outer diameter sized to engage the inner diameter of the termination ring, the ring adapter having a piston pocket extending radially inward from the outer diameter of the ring adapter, and a floating ring assembly retained within the piston pocket, the floating ring assembly moveable within the piston pocket; and moving a piston between a retracted position where an outer end of the piston is located within the piston housing, and an extended position where an outer surface of the piston engages an inner surface of the floating ring assembly, forming an auxiliary path from the terminal block to the ring adapter, the piston being located within the piston housing and having a central bore.

16. The method of claim 15, further comprising forming a seal between an inner face of the floating ring assembly and an opposite facing surface of the piston pocket with a face seal, the face seal circumscribing a receptacle bore of the floating ring assembly.

17. The method of claim 15, further comprising engaging a floating ring shoulder with a piston shoulder to push the floating ring assembly into sealing engagement with the piston pocket, the piston shoulder being an annular sloped surface located on the piston and the floating ring shoulder being an annular sloped surface located on an inner diameter surface of the floating ring assembly.

18. The method of claim 15, wherein the floating ring assembly includes a seal ring having a piston seal on an inner diameter of the seal ring that sealingly engages the outer diameter of the piston, and wherein the floating ring assembly further includes a seal carrier having a face seal located on an inner end surface of the seal carrier and an outer diameter seal that forms a fluid seal between an outer diameter of the seal carrier and the inner diameter of the seal ring.

19. The method of claim 18, wherein the piston has a pressure path extending through a sidewall of the piston, the pressure path being positioned so that the pressure path provides a pressure media path from within the central bore of the piston to an outer end surface of the seal carrier when the piston is in the extended position, providing a pressure on the outer end surface of the seal carrier to retain the face seal of the seal carrier in sealing engagement with an opposite facing surface of the piston pocket.

20. The method of claim 15, further comprising providing a spring member circumscribing an inner tube, the inner tube and spring member located within the piston pocket and the spring member sized to engage an inner diameter of the piston pocket, the inner tube having a piston seal on an inner diameter of the inner tube for sealingly engaging an outer diameter of the piston.

* * * * *